US010099489B2

(12) United States Patent
Porat

(10) Patent No.: US 10,099,489 B2
(45) Date of Patent: Oct. 16, 2018

(54) APPARATUS AND METHOD FOR TRIMMING A PRINT SHEET, AND REGISTERING THE LOCATION OF AN IMAGE

(71) Applicant: GP2 Technologies, Inc., Bow, NH (US)

(72) Inventor: Thomas Porat, Greenland, NH (US)

(73) Assignee: GP Squared Technologies, Inc., Bow, NH (US)

( * ) Notice: Subject to any disclaimer, the term of this patent is extended or adjusted under 35 U.S.C. 154(b) by 0 days.

(21) Appl. No.: 15/487,257

(22) Filed: Apr. 13, 2017

(65) Prior Publication Data

US 2017/0297352 A1 Oct. 19, 2017

Related U.S. Application Data

(60) Provisional application No. 62/323,366, filed on Apr. 15, 2016, provisional application No. 62/343,474, filed on May 31, 2016.

(51) Int. Cl.
*B41J 11/66* (2006.01)
*B41J 11/70* (2006.01)

(52) U.S. Cl.
CPC ..... *B41J 11/663* (2013.01); *B41J 11/70* (2013.01); *B41J 11/706* (2013.01)

(58) Field of Classification Search
CPC ..... B41J 11/663; B41J 11/70; B41J 11/706; B26D 1/00; B26D 1/0006
See application file for complete search history.

(56) References Cited

U.S. PATENT DOCUMENTS 6,354,502 B1 * 3/2002 Hagstrom ..... G06K 7/12 235/462.04
7,077,120 B2 * 7/2006 Funakoshi ..... B23D 59/002 125/13.01
7,249,903 B2 * 7/2007 Shaw, III ..... B41J 11/42 400/611
8,870,363 B2 * 10/2014 Ipponyari ..... B26D 1/045 101/224
9,039,313 B2 * 5/2015 Tsunoda ..... B26D 7/22 400/621

* cited by examiner

*Primary Examiner* — Anh T. N. Vo
(74) *Attorney, Agent, or Firm* — Finch & Maloney PLLC

(57) ABSTRACT

An apparatus and method are provided for trimming a print sheet and registering the location of an image on the print sheet. The apparatus may include a sensor system arranged to detect a guide line on the print sheet to align the print sheet relative to a cutter. The sensor system emits first and second light beams through the print sheet, and a controller is configured to detect the presence of the guide line through the light beams to align the guide line on the print sheet relative to the cutter. The apparatus may also include a vacuum chamber extending through a plate, with a float positioned within the vacuum chamber. In a first configuration, a vacuum is drawn in the chamber moving the float within the vacuum chamber away from the base such that a print sheet is moveably receivable between the plate and the base. In a second configuration, a positive pressure is created in the chamber moving the float within the vacuum chamber in a direction towards the base to contact a print sheet positioned between the plate and the base.

20 Claims, 8 Drawing Sheets

APPARATUS AND METHOD FOR TRIMMING A PRINT SHEET, AND REGISTERING THE LOCATION OF AN IMAGE

CROSS-REFERENCE TO RELATED APPLICATION

This application claims the benefit of U.S. Provisional Application No. 62/323,366, filed Apr. 15, 2016, and U.S. Provisional Application No. 62/343,474, filed May 31, 2016, both of which are incorporated by reference herein.

FIELD OF THE INVENTION

This disclosure relates generally to an apparatus and method for trimming a print sheet and registering the location of an image on the print sheet. The print sheet may be used as a cover for a hard cover book.

BACKGROUND

A print sheet may include one or more images printed on a standard size paper sheet. When used to form a case for a hard cover book, the print sheet must be trimmed to fit the specific dimensions of the book. After it is trimmed, the print sheet may be glued or otherwise secured to a rigid front panel, rigid back panel and rigid spine to form a book case which forms the front cover, the spine, and the back cover of a book. A book block (i.e. the stack of bound pages in the book) may be secured to the book case to complete the fabrication of the book.

In mass production of hard cover books, there is a large volume of print sheets featuring identical images, and all of the print sheets are trimmed to the same size. A large volume of print sheets may be trimmed with an industrial guillotine configured to cut through a stack of sheets at some specific distance from the edge of the stack for the specific dimensions of the hard cover book. In some cases fiducials or corner cut marks are used to visually indicate the expected cut position to the guillotine operator.

When the size and/or location of the images printed on the print sheets within a stack vary, the industrial guillotine may be impractical, requiring reconfiguration for each variation in size and/or location of the image on the print sheet. Therefore, in smaller scale production, the print sheet may be cut by hand. However, cutting by hand is time consuming and may be inaccurate.

Some steps in the case-making process require registering the trimmed sheet and this registration is typically done by moving the sheet so one edge (perhaps the top edge) contacts a stop bar and then the sheet is slid along this stop bar until an adjacent sheet side edge contacts a side stop. This process provides complete sheet registration. However, if the print sheet is not accurately trimmed, the printed graphics on the sheet may not be properly positioned. Case-making is the process of adhering a cover sheet to one or more rigid panels and folding the cover sheet around the panel edges for a neat appearance. Typically the amount of material folded over is approximately ¾". When the cover material is printed, proper registration of the printing to the panel may be more important than the amount of material folded over. Direct registration of the cover sheet printing to the rigid panels is most desirable in the case-making process. When this is not practical, accurate trimming of the print sheet is important.

SUMMARY

In one embodiment, an apparatus for trimming a print sheet is provided. The apparatus includes a base configured to receive a print sheet, and a cutter coupled to the base, the cutter arranged to cut at least a portion of the print sheet. The apparatus also includes a sensor system arranged to detect a guide line on the print sheet to align the print sheet relative to the cutter. The sensor system includes a first sensor configured to emit a first light beam through the print sheet, and a second sensor configured to emit a second light beam through the print sheet, where the first light beam is spaced apart from the second light beam. The apparatus further includes a controller in communication with the sensor system and the cutter, where the controller is configured to detect the presence of the guide line through the first and second light beams to align the guide line on the print sheet relative to the cutter.

In another embodiment, an apparatus for trimming a print sheet is provided. The apparatus includes a base configured to receive a print sheet, and a plate coupled to the base, the plate spaced apart from the base such that the print sheet is receivable between the plate and the base. The apparatus also includes a first vacuum chamber extending through the plate, with a first float positioned within the first vacuum chamber. In a first configuration, a vacuum is drawn in the first chamber moving the first float within the first vacuum chamber in a direction away from the base such that a print sheet is moveably receivable between the plate and the base. In a second configuration, a positive pressure is created in the first chamber, the positive pressure moving the first float within the first vacuum chamber in a direction towards the base to contact a print sheet positioned between the plate and the base.

In yet another embodiment, a method of registering the location of an image on a print sheet is provided. The method including providing a print sheet, the print sheet having a guide line which defines (or is related to) an outer perimeter of an image on the print sheet, emitting a first light beam through the print sheet to produce a first output, and emitting a second light beam through the print sheet to produce a second output, wherein the first light beam is spaced apart from the second light beam. The method also includes transmitting a signal including the first and second outputs to a controller, and moving the print sheet relative to the first and second light beams. The method further includes detecting the presence of the guide line through the first and second light beams to register the location of the outer perimeter of an image on the print sheet.

In another embodiment, a method of trimming a print sheet is provided. The method includes providing a print sheet and providing a base and a spaced apart plate. The method also includes applying a vacuum through a first vacuum chamber in the plate, such that a float positioned within the first vacuum chamber moves within the first vacuum chamber in a direction away from the base such that the print sheet is moveably receivable between the plate and the base. The method further includes inserting the print sheet between the base and the plate, and creating a positive pressure within the first vacuum chamber, such that the float positioned within the first vacuum chamber moves within the first vacuum chamber in a direction towards the base to contact the print sheet.

In another embodiment, an apparatus for registering the location of an image on a print sheet is provided. The apparatus includes a base configured to receive a print sheet, and at least one wheel coupled to the base, the at least one wheel arranged to move the print sheet relative to the base. The apparatus also includes a sensor system arranged to detect a guide line on the print sheet which defines an outer perimeter of an image on the print sheet. The sensor system includes a first sensor configured to emit a first light beam through the print sheet, and a second sensor configured to emit a second light beam through the print sheet, where the first light beam is spaced apart from the second light beam. The apparatus also includes a controller in communication with the sensor system and the wheel, where the controller is configured to move the print sheet relative to the base, and to detect the presence of the guide line through the first and second light beams to register the location of the outer perimeter of an image on the print sheet.

In yet another embodiment, an apparatus for trimming a print sheet is provided. The apparatus includes a base configured to receive a print sheet, and a plate coupled to the base, the plate spaced apart from the base such that the print sheet is receivable between the plate and the base. A first chamber extends through the plate and a first float is positioned within the first chamber. In a first configuration, the first float is positioned within the first chamber in a location away from the base such that a print sheet is moveably receivable between the plate and the base, and in a second configuration, a pressure is created in the first chamber, the pressure moving the first float within the first chamber in a direction towards the base to contact a print sheet positioned between the plate and the base.

In another embodiment, a print sheet for use in the manufacturing of a book is provided. The print sheet includes a paper sheet, the paper sheet having a sheet opacity, and at least one image printed on the paper sheet. The print sheet also includes a guide line printed about at least two edges of the image, the guide line having a guide line opacity which is greater than the sheet opacity, such that a sensor including a light beam can detect the guide line to determine the location of the perimeter of the image on the print sheet.

DETAILED DESCRIPTION

Figure 1:
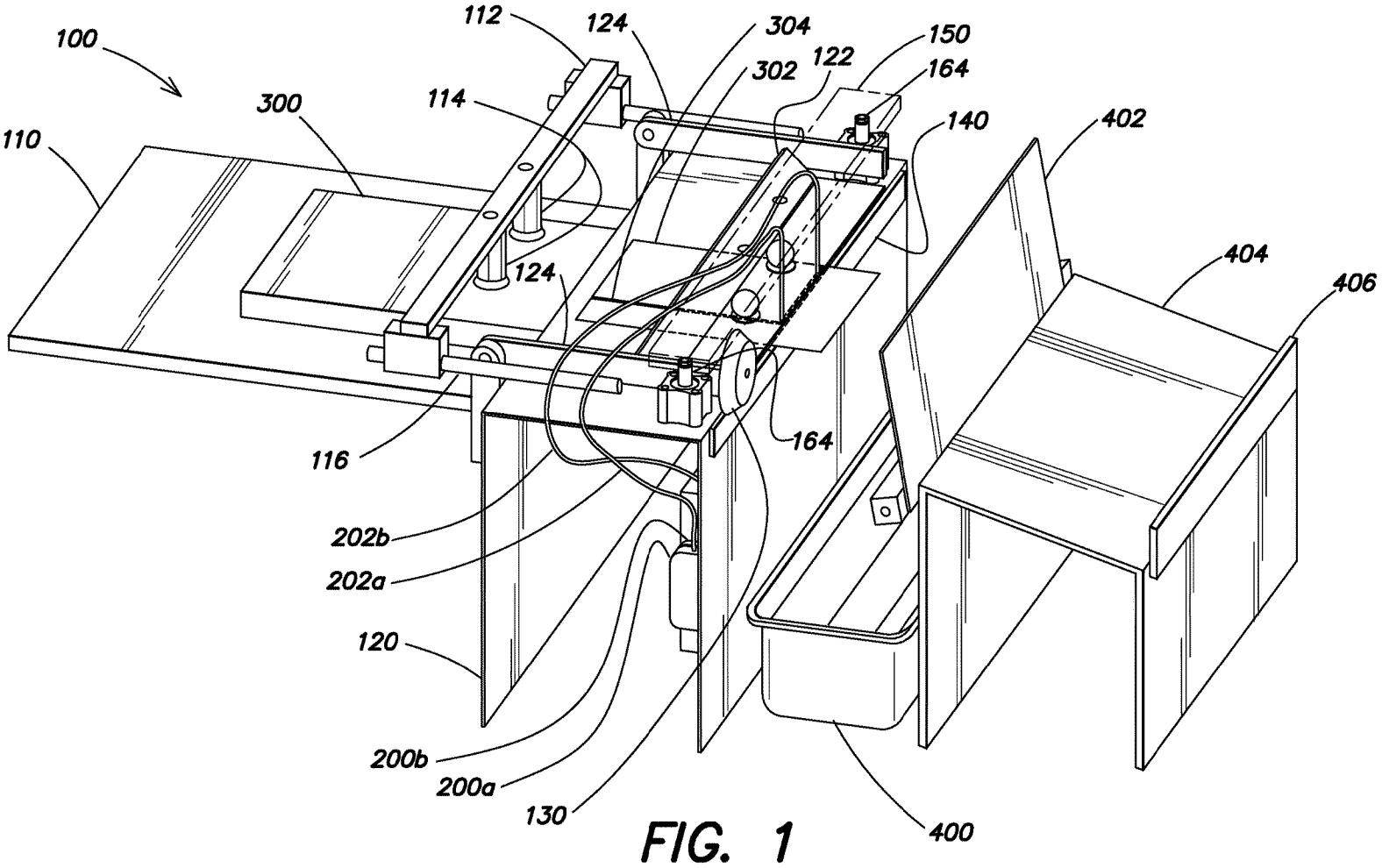
FIG. 1 is a perspective view of an apparatus for trimming a print sheet according to one embodiment of the present invention.

Accuracy when trimming a print sheet is critical. Small errors associated with trimming a print sheet may cause the images on the print sheet to be off-center when coupled to a hard cover book. An error in trimming a print sheet may cut off a portion of the image, and/or may otherwise cause the print sheet to not fit properly around the hard cover book.

An industrial guillotine may be used to trim a large volume of print sheets when the images on the print sheet are identical, when the position of the images on the print sheet are all the same, and when the dimensions of the hard cover book are the same. However, when any of the above variables change, the use of an industrial guillotine becomes impractical, because the apparatus must be reconfigured for each change in the print sheet.

The rise of the digital printing press has led to a growing requirement to print books on demand. Accordingly, much of the book production process has been modified to accommodate smaller production run sizes. One prior approach to trimming a print sheet includes sensing the location and/or position of an image on a print sheet with expensive cameras and extensive programming which only work when the printed image on the print sheet is positioned to face the camera, and requires frequent adjustment of the camera for variations in sheet surface (glossy, matte, texture, nylon, polyester, no film, aqueous UV coating). Another prior approach to trimming a print sheet includes sensing the location and/or position of an image on a print sheet with retro-reflective sensors, but this also requires adjustment for variations in the type of sheet surfaces, ambient lighting, and for small variations in the distance from the sensor (due to sheet curl).

Print sheets are often film laminated with a nylon or polyester material before the trimming process. The laminated print sheets can be made with a gloss, matte, and/or textured finish. Film laminated print sheets tend to curl, typically curling parallel to the grain of the print paper and typically the curl is towards the film. Moisture absorption may cause the print sheet to extend (cross grain) and because the film does not equally expand, the film laminate sheet may curl.

The inventor of the present application recognized a need for an apparatus for trimming a paper sheet which can accurately trim paper sheets to different dimensions based upon the size and/or location of the images on the print sheet. The inventor also recognized that the prior approaches mentioned above both require the print sheet to be oriented with the printed image facing towards the camera/sensor. The inventor recognized that due to paper curl, feeding and manipulating the print sheets may sometimes work better with the printed image facing up and other times may work better with the printed image facing down. Accordingly, the inventor recognized a need for an apparatus which trims a print sheet where the printed image on the print sheet can be oriented either facing up or facing down.

Printed fiducials or cut marks are commonly used for trimming print sheets. These marks are typically located at the intended corners of trimmed sheet. The marks are typically an "L" shape where two short lines (typically less than 1") meet at 90 degrees and the intersection of these lines indicate the intended cut position. These marks are typically used by industrial guillotine operators for visual alignment with the knife.

The inventor recognized that these cut marks have several deficiencies. First, it is assumed each pair of marks (indicating a cut position) will be parallel to the edge of the print sheet. Normal operation of a guillotine requires pushing a stack of sheets against a backstop, then moving the backstop (pushing the stack) toward the knife until the marks align with the knife. If the printed image (and cut marks) is not square with the sheet edges (perhaps the sheet itself is not square) there is no provision for this angular inaccuracy. Second, cut marks have thickness and the exact cut position relative to the mark is determined visually and is subjective. Also, graphics printed on a print sheet are often (but not always) center justified (center of graphics is at center of print sheet). Each cut mark must be identified in two axes.

They must be recognized within an area, not just along a line. This means an automated process where print sheets are transported along one direction cannot use fixed position sensors to reliably locate the cut marks. Cut marks (and any fiducial) can be located using cameras and vision systems capable of scanning an area however vision systems are expensive and complex. They must be programmed to recognize the specific fiducial and ignore all else. They may require specific lighting and may require recalibration for different surface material or textures. Finally, describing and communicating to graphic designers and/or programmers the exact requirements for printed fiducials to be recognized by automated equipment utilizing vision systems may be difficult and error prone.

A simple solution that addresses all of the deficiencies stated above is to print a line of constant thickness (for example, in one embodiment, a line approximately 0.080" thick) around the perimeter of the graphics. Each of these line segments may be recognized and utilized as a cut line. It is recognized that graphics may be printed as corner justified (one corner of graphics is located at one corner of the print sheet) and only require two cuts and therefore require only two cut lines. Use of a printed cut line allows the print sheet to be transported along one direction and a printed cut line to be recognized by one or more fixed position through beam sensors which are capable of distinguishing the change in opacity between the unprinted sheet and the printed line. The greatest differential in opacity may be desirable so in one embodiment, the cut line (guide line) is printed black. The content of the printed graphics is unknown and may abut the cut line. The content of the graphics (printed image) does not matter since the sensor recognizes the transition from low opacity (unprinted sheet) to high opacity (printed line) which is the outer edge of the line. Once the outer edge of the line is recognized, the sheet may be moved some programmable offset distance for proper cut positioning. The outer edge of the cut line is detected while the cut may be made at the inside edge of the line. It is recognized that the cut line need not be continuous. In one embodiment, the cut line (guide line) extends over a majority of a length and/or width of the printed image. The line is unnecessary except where it may be recognized by the sensor, but for simplicity of explanation and more flexibility and reliability in operation it may be best to print a continuous line along each edge of the graphics where a cut is to be made. Two sensors spaced apart some distance less than the minimum anticipated length of a printed cut line would allow a printed line to be aligned with a cutter.

As set forth in greater detail below, one aspect of the present invention is directed to an apparatus for trimming a print sheet that includes a sensor system arranged to detect a guide line on the print sheet to align the print sheet relative to a cutter. The guide line may be positioned around an image on the print sheet. The apparatus may be configured to move the print sheet to align the print sheet with the cutter such that the cutter removes substantially all, or at least a portion of, the guide line when trimming the print sheet. As discussed below, it is contemplated that the sensor system is aligned with the cutter such that once the sensor system detects a guide line, the print sheet is in position to be trimmed by the cutter. It is also contemplated that the sensor system is offset from the cutter, such that once the sensor system detects a guide line, the print sheet must be moved a programmed offset distance to align the guide line with the cutter. As set forth below, the sensor system may emit first and second light beams through the print sheet, and the apparatus may further include a controller configured to detect the presence of the guide line through the light beams to align the guide line on the print sheet relative to the cutter.

Another aspect of the present invention outlined below is directed to an apparatus for trimming a print sheet with a positioning mechanism which features a vacuum chamber. As discussed below, by adjusting the pressure within the vacuum chamber the positioning mechanism can move between an open position configured to receive a print sheet and a closed position in which the mechanism contacts the print sheet. As discussed below, this contact with the print sheet may create friction between the print sheet and the wheels used to move the print sheet. The apparatus may be configured such that the pressure within the vacuum chamber is variable between a vacuum being applied in a first direction and a positive pressure applied in the opposite direction. As described in more detail below, the vacuum chamber may extend through a plate, with a float positioned within the vacuum chamber. As shown in the figures, in one embodiment, the float is configured as a ball. In a first configuration, a vacuum is drawn in the chamber moving the float within the vacuum chamber away from the base such that a print sheet is moveably receivable between the plate and the base. In a second configuration, a positive pressure is created in the chamber moving the float within the vacuum chamber in a direction towards the base to contact a print sheet positioned between the plate and the base.

Another aspect of the present invention outlined below, is directed to an apparatus for registering the location of an image on a print sheet where the apparatus includes a sensor system arranged to detect a guide line on the print sheet which defines an outer perimeter of an image on the print sheet. The apparatus includes at least one wheel arranged to move the print sheet, and a controller configured to move the print sheet and detect the presence of the guide line through the first and second light beams to register the location of the outer perimeter of an image on the print sheet. Once the location of the outer perimeter of an image on a print sheet is registered, downstream manufacturing steps, including, but not limited to trimming the print sheet, aligning the print sheet relative to a rigid front panel, rigid back panel and rigid spine, folding an edge of the print sheet, and/or gluing the print sheet to a rigid panel or spine, can be performed with greater accuracy.

One illustrative embodiment of the present invention includes an apparatus for trimming a print sheet which includes all of the above mentioned features: a sensor system arranged to detect a guide line on the print sheet to align the print sheet relative to a cutter, a positioning mechanism which features a vacuum chamber, and a sensor system configured for registering the location of an image on a print sheet. However, it should be appreciated that other embodiments of the present invention are directed to an apparatus which includes only one or two of these features, as the invention is not so limited. For example, in one embodiment, the apparatus only includes the first sensor system, in another embodiment, the apparatus only includes the positioning mechanism, and in another embodiment, the apparatus may only include the sensor system configured for registering the location of an image on a print sheet, as the invention is not so limited.

Figure 2:
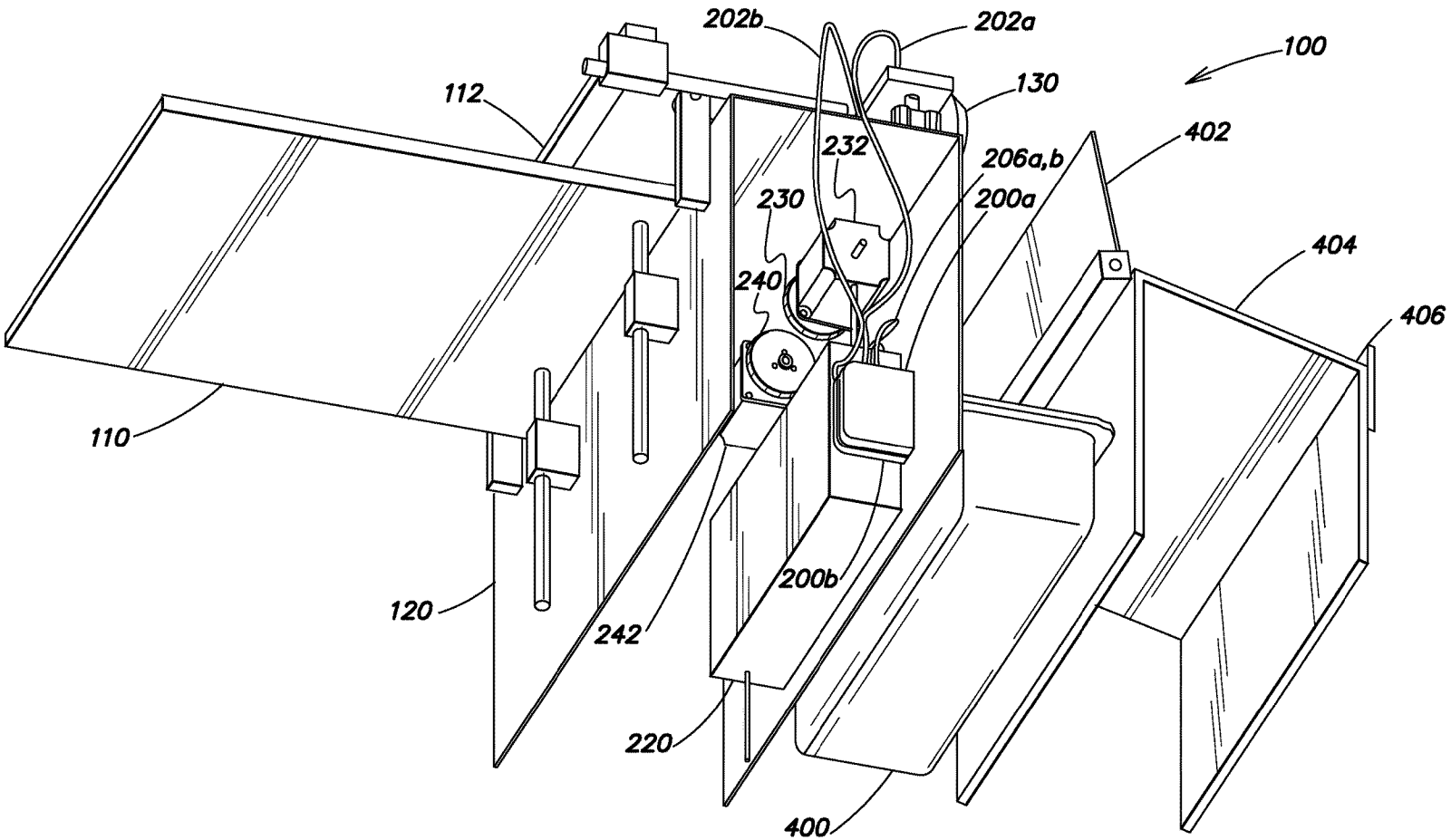
FIG. 2 is another perspective view of the apparatus shown in FIG. 1.

Turning to FIGS. 1-2, one embodiment of an apparatus 100 for trimming a print sheet 302 is illustrated. The apparatus includes a base 120 configured to receive a print sheet 302 and a cutter 130 is coupled to the base arranged to cut at least a portion of the print sheet. In this illustrative embodiment, the cutter 130 is a circular knife configured to rotate across a portion of the base 120, but other types of cutters 130 known to one of ordinary skill in the art are also contemplated, as the invention is not so limited. As shown, the base 120 may include a shear bar 140 positioned along one side of the base 120, and the cutter 130 is configured to slide along the length of the shear bar 140, in either direction, to cut the print sheet 302.

As shown in FIG. 1, the trimming apparatus 100 may include a lift table 110 adjacent the base 120. As illustrated, the lift table 110 is configured to receive a stack 300 of print sheets to be cut by the cutter 130. One or more vacuum cups 114 may be positioned above the lift table 110 configured to separate one print sheet from the stack 300 and move the print sheet from the lift table 110 over to the base 120. In this embodiment, the vacuum cups 114 are coupled to a feeder bar 112 which is slidably movable along slide shafts 116 which are coupled to the base 120 through horizontal pivot mounts 124. Although not illustrated, a vacuum source may be used to draw a vacuum through the vacuum cups 114 to lift a print sheet from the print sheet stack 300. It is contemplated that the vacuum may be drawn through the two ports in the feeder bar positioned directly over the vacuum cups 114.

As mentioned above, aspects of the present invention are directed to an apparatus for trimming a print sheet that includes a sensor system arranged to detect a guide line on the print sheet to align the print sheet relative to a cutter. As shown in FIG. 1, the guide line 304 may be positioned around a printed image on the print sheet 302. In one embodiment, the guide line 304 defines the outer perimeter edge to be cut by the cutter. For example, in one embodiment, the guide line 304 may be substantially rectangular shaped, although other shapes are also contemplated. In one embodiment, the graphics (printed image) are corner justified on the print sheet, therefore requiring only two guide lines and only two cuts.

Figure 3:
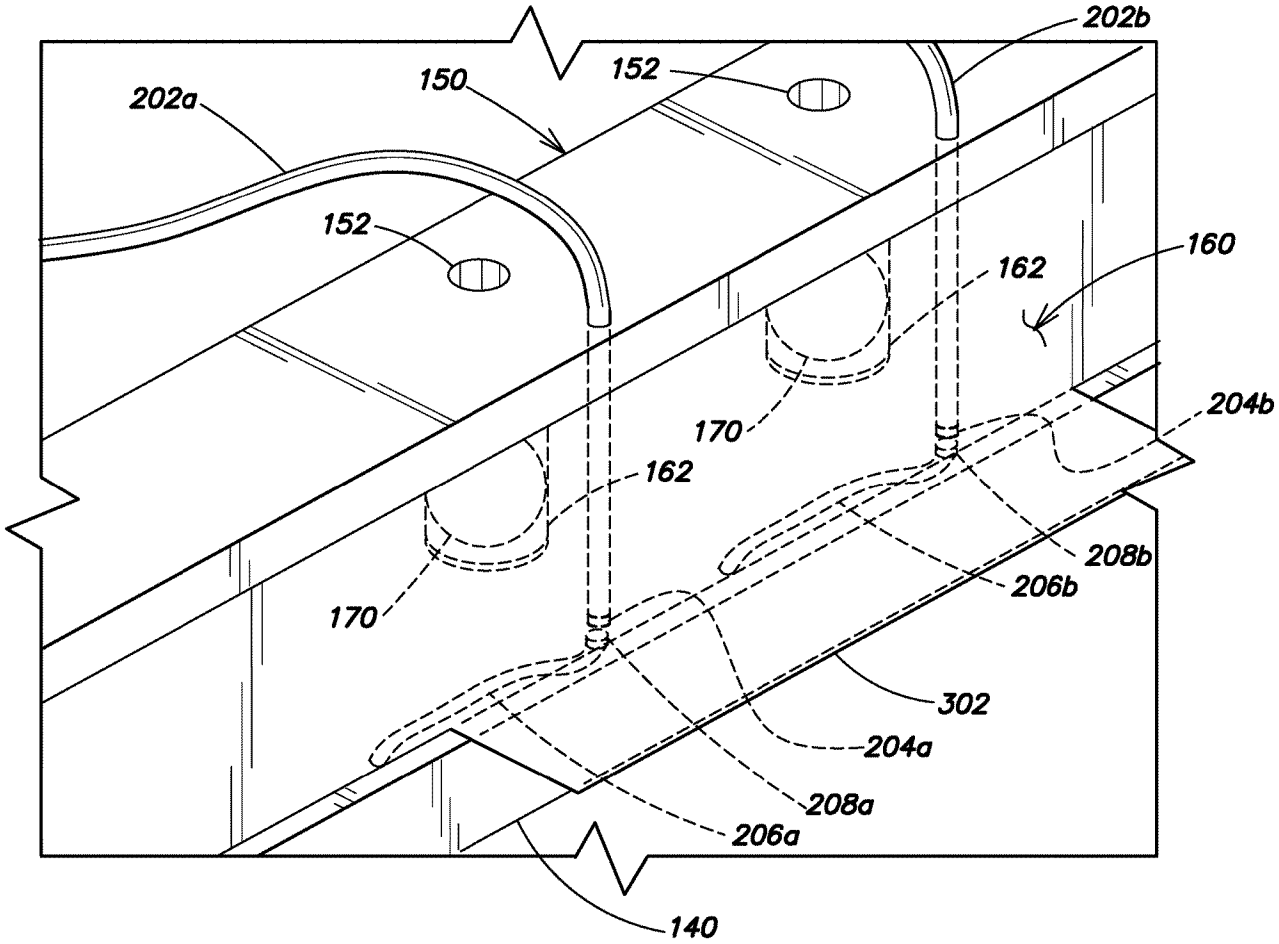
FIG. 3 is a perspective view of a portion of the apparatus illustrating the sensor system and vacuum chambers in greater detail.

As shown in FIGS. 1-3, in one illustrative embodiment, the sensor system includes a first sensor 200*a* and a second sensor 200*b*. In one embodiment, the first sensor 200*a* is configured to emit a first light beam through the print sheet 302, and a second sensor 200*b* is configured to emit a second light beam through the print sheet 302.

The inventor of the present application recognized that by emitting a light beam through the translucent (at a specific range of wavelengths) print sheet, information about the location of the print sheet relative to the cutter can be obtained. For example, in one embodiment, the sensors 200*a*, 200*b* are analog output sensors which are configured for "through beam" operation with a sensor emitter (FIG. 3, 204*a*, 204*b*) spaced apart from a sensor receiver (FIG. 3, 208*a*, 208*b*). A light beam passes through from the sensor emitter to the sensor receiver. The light beam may be non-destructive meaning that it does not damage the print sheet. In one illustrative embodiment, in an ambient state, with just air between the sensor emitter 204*a*, 204*b* and the sensor receiver 208*a*, 208*b*, the voltage output of a sensor 200*a*, 200*b* may be approximately 9.0 V DC. When a white (unprinted) print sheet is placed between the sensor emitter 204*a*, 204*b* and the sensor receiver 208*a*, 208*b*, the voltage output of a sensor 200*a*, 200*b* may drop to approximately 3.0V DC, and when a darkened guideline 304 (which is less translucent than the white print sheet, such that the guide line has a guide line opacity which is greater than the sheet opacity) is positioned between the sensor emitter 204*a*, 204*b* and the sensor receiver 208*a*, 208*b*, the voltage output of the sensor 200*a*, 200*b* may drop to approximately 1.0V DC. Accordingly, the sensor output can be used to determine information about the position of the print sheet and the location of the guide line on the print sheet. Furthermore, because the light beam passes through the print sheet, the inventor recognized that this sensor system will work regardless of whether the printed image on the print sheet is facing up or facing down.

In one particular embodiment, the sensor system utilizes a visible red light beam having a wavelength of approximately 680 nm. In another embodiment, a light beam having a different wavelength may be used. In one embodiment, the sensor system may include an infrared light beam.

As shown in FIG. 2, the apparatus further includes a controller 220 which is in communication with the sensor system and the cutter 130. The controller is configured to detect the presence of the guide line 304 through the first and second light beams to align the guide line on the print sheet relative to the cutter. In one embodiment, the controller is configured to detect an edge of the print sheet. As mentioned above, the sensors 200*a*, 200*b* may produce an output indicative of the sensors first detecting the presence of the print sheet through one of the light beams. Once the controller detects both the edge of the print sheet and the guide line, the controller can calculate the distance between the guide line and the edge. In one embodiment, the controller is configured to determine the position of a printed image on the print sheet where the guide line defines the perimeter of the printed image on the print sheet.

As shown in the embodiment illustrated in FIGS. 1-3, the first sensor 200*a* includes a first fiber optic cable 202*a* having a first end 204*a* (see FIG. 3) forming the sensor emitter, and a second fiber optic cable 206*a* having a second end 208*a* forming the sensor receiver, where the second fiber optic cable 206*a* is spaced apart from the first end 204*a* of the first fiber optic cable 202*a* to form a space there between configured to receive the print sheet 302. In this embodiment, the first and second fiber optic cables 202*a*, 206*a* are configured such that first light beam travels through the first end 204*a* of the first fiber optic cable to the end 208*a* of the second fiber optic 206*a*.

As shown, in one embodiment, the second sensor 200*b* is configured to emit a second light beam through the print sheet 302. As shown in FIGS. 1-3, the second sensor 200*b* may be substantially identical to the first sensor 200*a* and may include a third fiber optic cable 202*b* having a first end 204*b* (see FIG. 3) forming the sensor emitter, and a fourth fiber optic cable 206*b* having an end 208*b* forming the sensor receiver, where the fourth fiber optic cable 206*b* is spaced apart from the first end 204*b* of the third fiber optic cable 202*a* to form a space there between configured to receive the print sheet 302. In this embodiment, the third and fourth fiber optic cables 202*b*, 206*b* are configured such that the second light beam travels through the first end 204*b* of the third fiber optic cable to the end 208*b* of the fourth fiber optic 206*b*.

The first and second light beams which pass through the fiber optic cables 202*a*, 202*b* may be oriented such that if the guide line 304 is substantially parallel to the edge of the print sheet, the first and second light beams may detect the guide line at substantially the same time. However, if the guide line is positioned differently, the apparatus may be configured to rotate the print sheet 302 once the first light beam detects the guide line until the second light beam also detects the guide line. This approach may help to ensure that the guide line is properly aligned relative to the cutter.

Although one of ordinary skill in the art will appreciate that a variety of types of known sensors may be implemented, in one particular embodiment, the sensors 200*a*, 200*b* are both Banner Model D10UNFP, available from Banner Engineering from Minneapolis, Minn. This type of sensor can be a dual output type, and can be used as analog output sensors with a voltage signal ranging from 0-10V DC. It is also contemplated that an analog current signal may be used. In one embodiment, dual digital output sensors may be used, and in one particular embodiment, single analog output sensors may be implemented.

One of ordinary skill in the art will also appreciate that a variety of types of controllers may also be utilized, but in one particular embodiment, the controller 220 is a Galil model DMC 4080 motion controller, available from Galil, Rocklin, Calif. The operating program may be written to scan the analog inputs using preset thresholds and it can be determined when there is nothing but air between the sensor emitter and the sensor receiver, when there is a white print sheet between the sensor emitter and the sensor receiver, and when there is a darkened guide line positioned between the sensor emitter and the sensor receiver. In one particular embodiment, the preset thresholds may be set at 6.0 V DC for detecting the white print sheet and 2.0 V DC for detecting the darkened guide line. Although most print sheets are white, the methods and apparatus described herein can operate with any color print sheet provided that the sensors can recognize the opacity difference between the print sheet and the guide line.

In one embodiment, the guide line may be a substantially black line on the print sheet. One of ordinary skill in the art would recognize that other darkened color shades may be used for the guide line and that the color of the guide line must differ from the color of the print sheet so that when a light beam of the sensor system passes through the guide line that the controller can detect the presence of the guide line on the print sheet.

Figure 4:
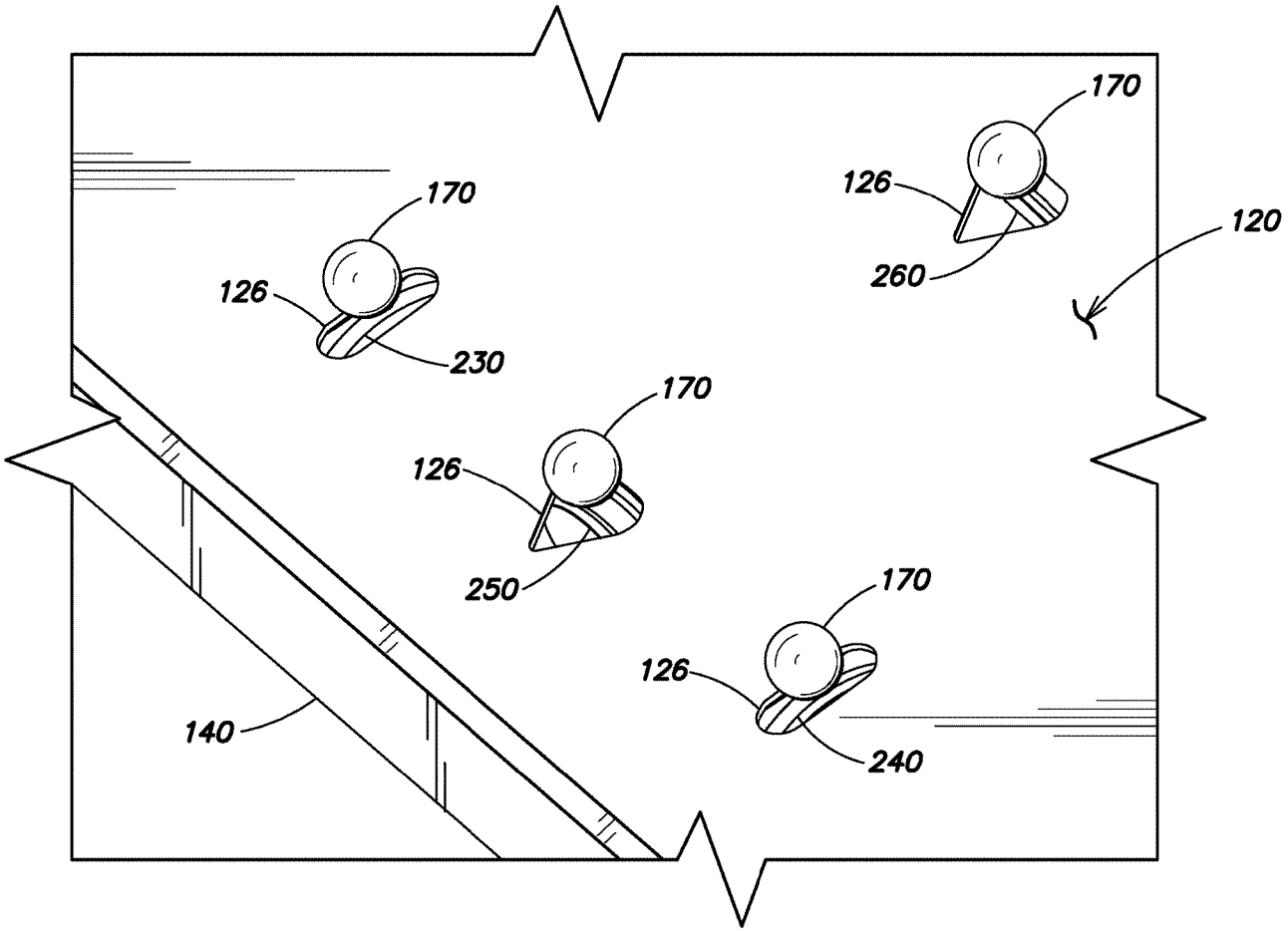
FIG. 4 is a perspective view of a portion of the apparatus according to another embodiment of the present invention illustrating a plurality of wheels coupled to the base.

As shown in FIGS. 2 and 4, the apparatus 100 may include at least one wheel 230, 240 coupled to the base 120 and configured to move the print sheet 302 relative to the cutter 130. In one embodiment, the controller 220 is in communication with the one or more wheels 230, 240 to initiate movement of the wheel 230, 240. It is contemplated that the controller 220 is configured to move the print sheet when the first and second light beams are not aligned with the guide line 304. As set forth in greater detail below, in one embodiment, it is also contemplated that once the first and second light beams are aligned with the guide line 304, the controller is configured to move the print sheet a programmed offset distance to align the cutter 130 and the guide line 304 such that the cutter is configured to remove the guide line 304 from the print sheet 302. This programmed offset distance may be substantially equal to the distance that the sensors 200*a*, 200*b* (and associated light beams) are offset from the cutter 130.

As shown in FIG. 2, in one embodiment, the apparatus 100 includes two wheels 230, 240 to move the print sheet along the base 120. As shown, a left wheel 230 may be coupled to the underside of the base 120 and a right wheel 240 is spaced apart from the left wheel 230 and may also be coupled to the underside of the base 120. Adjacent each wheel 230, 240 is a motor 232, 242 with a motor shaft connected to its respective wheel. Each motor 232, 243 is in communication with the controller 220 to initiate movement of the wheels 230, 240. In one embodiment, a stepper motor is used powered by a stepper drive which is controlled by controller 220.

FIG. 4 illustrates another embodiment which features four wheels 230, 240, 250, 260 to move the print sheet 302. As shown, in this embodiment, left and right wheels 230, 240 are positioned to rotate substantially about the same axis of rotation, and wheels 250, 260 are positioned to rotate substantially about a different axis of rotation which is substantially perpendicular to the left and right wheel axis. Two wheels (when positioned on the same axis or on different axes), when rotated independently, may impart two axes of movement to the print sheet (fore/aft and twist). With the above described sensor system, this movement in two directions is sufficient to align the guide line 304 with the cutter 130 (x and θ). Complete registration of the print sheet along a plane may require proper positioning of the print sheet in a third direction (for example, along the cutter edge). For example, as shown in FIG. 4, third and fourth wheels 250, 260 may be added. In one embodiment, these wheels 250, 260 are driven together by a third independent motor (not shown) to allow complete positioning of a sheet 302 on a surface of the base 120 (x, y and θ).

FIG. 4 also illustrates a configuration where the wheels are mounted to the underside of the base 120, where the base includes a plurality of openings 126, each configured such that a portion of the wheel 230, 240, 250, 260 extends into an opening 126. Each wheel is located and mounted so that the top tangential surface of the wheel is approximately at the top surface of the base 120 upon which the print sheet 302 slides. In one particular embodiment, each wheel is approximately 2 inches in diameter with a narrow (approximately 0.187 inch thick) friction (buna-N) surface to maximize engagement with the print sheet 302. The floats 170 shown in FIG. 4, and how they may interact with the wheels 230, 240, 250, 260 is discussed in greater detail below.

The above described sensor system has been described with respect to aligning the guide line on the print sheet relative to a cutter. It is also contemplated that this above-described sensor system may be utilized for other aligning steps during the book making process, such as but not limited to, aligning an adhesive to the print sheet and/or hard cover book to secure the print sheet to the book and/or aligning the print sheet about a fold line to fold the print sheet about the cover, and/or aligning print sheets for processing within automated book case making machinery. For example, after the print sheet is trimmed, a controller may be configured to dispense an adhesive along a guide line positioned on the print sheet. Furthermore, a controller may be configured to fold the print sheet along a guide line positioned on the print sheet.

Accordingly, in one embodiment, an apparatus for registering the location of an image on a print sheet is provided. In one embodiment, this apparatus may not include a cutter. The apparatus includes a base configured to receive a print sheet, and at least one wheel arranged to move the print sheet relative to the base. The apparatus also includes a sensor system arranged to detect a guide line on the print sheet which defines an outer perimeter of an image on the print sheet. The sensor system may be substantially similar to the one described above and shown in FIGS. 1-3 which emits first and second light beams. A controller is in communication with the sensor system and the wheel, and the controller is configured to move the print sheet relative to the base, and to detect the presence of the guide line through the first and second light beams to register the location of the outer perimeter of an image on the print sheet using the above-described light beams to indicate the presence of either air, the print sheet, or the guide line. Prior to the present invention, manufacturing steps on the print sheet typically relied on registering the perimeter/edge of the print sheet. Some inaccuracy is introduced in the printing process when a sheet may not be properly positioned during printing. Known prior art does not correct for this type of position error. By registering the perimeter of the image, the accuracy of subsequent manufacturing steps may be improved.

Turning back to FIGS. 1-2, the apparatus 100 may also include a waste bin 400 adjacent the cutter 130 that is configured to receive a portion of the print sheet 302 that has been removed by the cutter 130. The apparatus 100 may also include an output table 404 configured to receive a finished (cut) print sheet 302. As illustrated, the output table 404 may have a waste diverter 402 moveable between an open position (shown in FIGS. 1-2) where cut portions of the print sheet 302 can fall into the waste bin 400, and a closed position (shown in FIG. 8) where the waste diverter couples the base 120 to the output table 402 such that a finished (cut) print sheet is moveable from the base 120 to the output table 404.

As mentioned above, aspects of the present invention are directed to an apparatus for trimming a print sheet with a print sheet positioning mechanism which features a vacuum chamber. As discussed below, by adjusting the pressure within the vacuum chamber the positioning mechanism can move between an open position configured to receive a print sheet and a closed position in which the mechanism contacts the print sheet. In one embodiment, this positioning mechanism may be utilized while trimming the print sheet to engage the print sheet with drive wheels used to move the print sheet into a desired position. It is also contemplated that this below-described positioning mechanism may be utilized for other steps during the book making process, such as but not limited to gluing an adhesive to the print sheet and/or hard cover book to secure the print sheet to the book, and/or folding the print sheet.

As shown in FIG. 3, in one particular embodiment, the apparatus 100 includes a plate 160 coupled to and spaced apart from the base 120 such that a print sheet 302 is receivable between the plate 160 and the base 120. As shown in FIG. 3, first and second vacuum chambers 162 extend through the plate 160. A first float 170 is positioned within the first vacuum chamber 162 and a second float 170 is positioned within the second vacuum chamber 162. In a first configuration, a vacuum source (not shown) is used to draw a vacuum in the first and second chambers 162 moving the first float 170 within the first vacuum chamber 162 and the second float 170 within the second vacuum chamber 162 in a direction away from the base 120 such that a print sheet 302 is moveably receivable between the plate 160 and the base 120. In this configuration, a print sheet may be inserted onto the base 120 and moved into a desired position. In a second configuration, a positive pressure may be created in the first and second chambers 162, the positive pressure moving the first and second floats 170 respectively within the first and second vacuum chambers 162 in a direction towards the base 120 to contact the print sheet 302 between the plate 160 and the base 120. In this configuration, the floats 170 may engage the top surface of the print sheet 302 and may cause the wheels positioned below the floats 170 to engage the bottom surface of the print sheet 302 thereby creating friction, enabling the wheels to move the print sheet.

The vacuum and the positive pressure may be drawn into the vacuum chambers 162 through two bores 152 (see FIG. 1) in cap plate 150 which is adjacent the plate 160, as would be understood by one of ordinary skill in the art. In one embodiment, horizontal motion of the floats 170 within the chambers 162 is limited, but the float 170 is configured to move up and down within the chamber based upon the pressure within the chamber. Initially, a vacuum may be drawn causing the float to lift away from the associated wheel (see FIG. 4) creating an unobstructed path for the print sheet 302 to be fed into position where the leading edge of the print sheet 302 is at least beyond the centerline of the wheel. Once the print sheet 302 is in position, the vacuum may be turned off and an adjustable pressure may be applied in the chambers 162 over the floats 170. This air pressure increases the force the floats 170 exert downwardly onto the print sheet 302 and thus increases the friction between the print sheet 302 and each wheel 230, 240, 250, 260. In other embodiments, the weight of the floats 170 may be sufficient to provide enough force in the absence of positive pressure from the chambers 162.

In one illustrative embodiment, the plate 160 is positioned above the base 120, such that a vacuum lifts the floats 170 up and out of engagement with the print sheet 302 and a positive pressure lowers the floats 170 to clamp down the print sheet. It is also contemplated that the plate 160 and base 120 may be configured differently, for example, flipping the assembly over, such that a pressure causes the float 170 to engage the print sheet and gravity disengages it. For example, in one embodiment, gravity may move the first float within the first chamber in a direction away from the base such that a print sheet is moveably receivable between the plate and the base. It is also contemplated that the floats could be replaced with steel balls or plastic coated steel balls that could be positioned magnetically, as the invention is not so limited.

In one illustrative embodiment shown in FIG. 4, each wheel 230, 240, 250, 260 is aligned with a corresponding float 170. When a positive pressure is applied within each vacuum chamber 162, the floats 170 move within the chambers 162 in a direction toward the corresponding wheel 230, 240, 250, 260 to engage the print sheet 302 between each float 170 and wheel. As mentioned above, each wheel may include a high friction surface to prevent any undesirable slipping of the print sheet relative to the wheels.

The inventor recognized that using the air pressure over the floats 170 instead of using a weighted ball without air pressure may have at least two benefits. First, it adds very little moving mass to the apparatus. Second, it is easily adjustable for various types of print sheets. Furthermore, the illustrated embodiment includes two spaced apart vacuum chamber 162 and associated floats 170. It is contemplated that an apparatus could employ only one vacuum chamber 162 and float 170, as the invention is not so limited. However, it may be desirable to have a plurality of vacuum chambers 162 and floats 170 to prevent undesirably movement of the print sheet during the trimming process.

In one illustrative embodiment shown in FIG. 4, the first and second floats 170 are substantially spherical in shape. However, other shapes, such as, but not limited to egg-shaped and cylindrical shaped are also contemplated as the invention is not so limited. Furthermore, in one illustrative embodiment, the first and second vacuum chambers 162 are substantially cylindrical shaped with an approximately 1 inch diameter and each include a substantially circular shaped bore machined into the plate 160. The diameter of the first float 170 may be substantially equal to the diameter of the first vacuum chamber 162, and the diameter of the second float 170 may be substantially equal to the diameter of the second vacuum chamber 162. In one embodiment, the first and second floats 170 are each a plastic ball having a diameter of approximately 1 inch. As shown in FIG. 1, mounted below the plate 160 may be a sheet guide 122 which may extend upwardly beyond the plate 160 to create a "duck-bill" shape to guide the print sheet 302 between the plate 160 and the base 120.

According to one embodiment, air cylinders 164 are provided to selectively lower the plate 160 towards the base 120 to clamp the print sheet into position before trimming the print sheet. When a print sheet 302 is being fed into the apparatus or when the print sheet is being manipulated into position, the distance between the plate 160 and the base 120 may be approximately 0.06 inches, allowing the print sheet 302 to move freely. When the guide lines of the print sheet 302 have been aligned relative to the cutter 130 and the print sheet is ready to be trimmed, the air cylinders 164 may be actuated to cause the plate 160 to move down towards the base 120 to clamp the print sheet 302 in position during the cut.

As mentioned above, the present invention also contemplates a method of registering the location of an image on a print sheet. The method includes providing a print sheet 302, the print sheet having a guide line 304. The method further includes emitting a first light beam through the print sheet 302 to produce a first output, and emitting a second light beam through the print sheet 302 to produce a second output, where the first light beam is spaced apart from the second light beam. The print sheet is moved relative to the first and second light beams, and a signal including the first and second outputs is transmitted to a controller to detect the presence of the guide line through the first and second light beams to register the location of the outer perimeter of an image on the print sheet. As mentioned above, in one embodiment, the first and second outputs are analog voltage outputs. Other types of outputs, including but not limited to current outputs are also contemplated as the invention is not limited in this respect. Additionally sensors having multiple digital outputs may be used.

In one embodiment, the method further includes moving the print sheet 302 based upon the first and second outputs to align the guide line 304 on the print sheet 302 relative to a cutter 130. Once the guide line 304 is aligned relative to the first and second light beams, the controller 220 may activate the cutter 130 to cut at least a portion 306 of the print sheet 302.

In one embodiment, once the guide line 304 is aligned with the light beams, the print sheet 302 may be moved a programmed offset distance to align the guide line with the cutter 130 such that the cutter is configured to remove the guide line 304 from the print sheet 302. This programmed offset distance may be substantially equal to the distance that the sensor fiber optic cables 202*a*, 202*b* (and associated light beams) are offset from the cutter 130. Thereafter, the controller 220 may activate the cutter 130 to cut at least a portion of the print sheet.

In one embodiment, the method further includes detecting an edge of the print sheet to calculate the distance between the guide line 304 and the edge of the print sheet 302. As mentioned above, the sensor system may be programmed to produce a first output (which may indicate a change in voltage and/or current) when the light beam detects the print sheet, and a second output when the light beam detects the guide line. The controller can calculate the distance between the guide line and the edge by determining the rotation of the wheels to advance the print sheet between the two positions. One of ordinary skill in the art would appreciate that the controller can be programmed to obtain the edge location of both the print sheet and the guide line.

In one embodiment, a stack 300 of print sheets having common dimensions is loaded onto the lift table 110 and the operator may enter the sheet length and width dimensions into the operating system. These dimensions may be used to re-center the print sheet after each cut. By using the pre-trim sheet dimensions and recognizing and recording the sheet edge position and tracking the distance traveled from that position to the guide line and the cut position, the dimension of the remainder of the sheet (perpendicular to the knife) is known, and the remainder of the sheet can be driven and stopped so that the centerline of the sheet is between the two drive wheels. Once centered, the wheels can be driven in opposite directions to cause the sheet to rotate. The wheels may be driven a programmable number of degrees to cause either a substantially 90 degree or a substantially 180 degree rotation of the sheet. The rotation accuracy (+/−5 degrees) may not be critical as the sensors may realign the sheet for accurate cutting.

In another embodiment, a third sensor may be added to the apparatus spaced apart from the fiber optic cables 202*a*, 202*b* (and associated light beams) on the side opposite the drive wheel. In one embodiment, the third sensor may be positioned along the cap plate 150 with its associated fiber optic cables extending through the cap plate 150 (similar to the configuration of the fiber optic cables associated with the first and second sensors). As illustrated in the top view shown in FIG. 7, the fiber optic cables 202*a*, 202*b* associated with the first and second sensors are shown positioned on the right side of the cap plate. It is contemplated that in one embodiment, the fiber optic cables associated with the third sensor are positioned on the left side of the cap plate, although the location of the third sensor may vary as the invention is not so limited. With the addition of the third sensor, the operator may not have to input the outer dimensions of the print sheet. Instead, the third sensor may be used to determine the sheet dimensions by transporting the sheet between the three sensors and then tracking the distance travelled. By knowing the distance between the sensors, the controller could then calculate the sheet dimensions.

In yet another embodiment, to gain dimensional data, one could drive the first edge of the print sheet to the first sensor, and then drive the sheet a known distance further (for example, 6 inches), stop and rotate the print sheet approximately 180 degrees, and then drive the sheet backward until the sensor identifies the other (opposite) sheet edge.

In one embodiment, the method of trimming a print sheet involves cutting the print sheet and thereafter using the sensors to determine whether the guide line was completely removed from the print sheet. The sensors may emit first and second light beams and a signal may be transmitted to the controller to determine whether either the print sheet or the guide line is present. If the apparatus detects that at least a portion of the print sheet or guide line remains, the cutter may re-cut at least a portion of the print sheet. In one embodiment all or a portion of the guide line may remain after the cut, as the invention is not so limited.

As mentioned above, in one embodiment, the cutter 130 is a circular knife configured to move along the shear bar 140. In one embodiment, the circular knife may be positioned substantially parallel to the shear bar 140 configured to travel substantially parallel to the shear bar. In another embodiment, the circular knife may be configured to rock so that in either travel direction, the leading edge is in contact with the shear bar. Setting the knife can be difficult. When a knife is not properly set, the knife and shear bar assembly may cut better in one direction and less reliable in the opposite direction. In a less reliable cut, the circular knife may ride up over the print sheet while folding it along the shear bar, or the circular knife makes a partial cut before riding up and onto the sheet.

Accordingly, in one embodiment, after each cut, the sensors checks for the presence of material (checking for either white print sheet or darkened guide line). It may be desirable for the sensors to detect no material present after a complete cut. In one embodiment, after each cut, the wheels may drive the sheet backward, away from the knife to allow the sensors to check for the presence of material. In one embodiment, the wheels drive the sheet backwards approximately 0.5 inches which may be approximately equal to or greater than the programmed offset distance.

If the controller detects the presence of material (either guide line or white print sheet), the wheels may drive the sheet back to the cut position to initiate a re-cut. In one embodiment, the circular knife is positioned at a first end of the shear bar 140 before the first cut, and the knife is positioned at the second opposite end of the shear bar before the re-cut. Therefore, the knife may move in a second opposite direction for the re-cut. As mentioned above, the circular knife may cut better in one direction than the second opposite direction. Accordingly, this movement of the knife in the opposite direction for the re-cut may be more effective for cutting. After the re-cut, the wheels may again drive the print sheet back and the cut may be checked.

In one embodiment, when an incomplete cut is detected, the travel direction of the circular knife is recorded and reported at a machine control station. This information may be helpful to the machine operator to determine which direction the circular knife should be adjusted to be more parallel to the shear bar.

Figure 5:
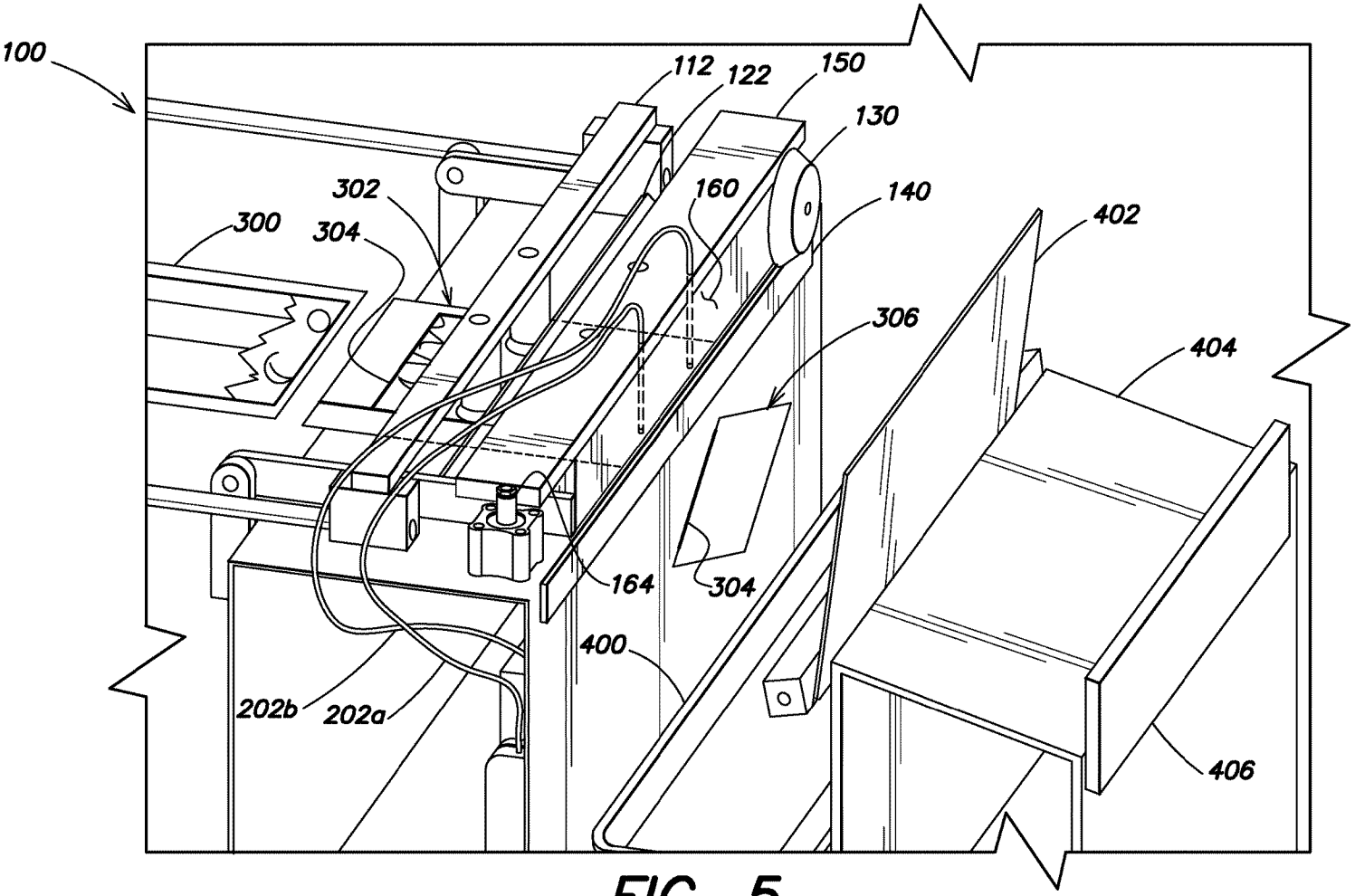
FIG. 5 is a perspective view of the apparatus cutting a portion of an unfinished print sheet.
Figure 6:
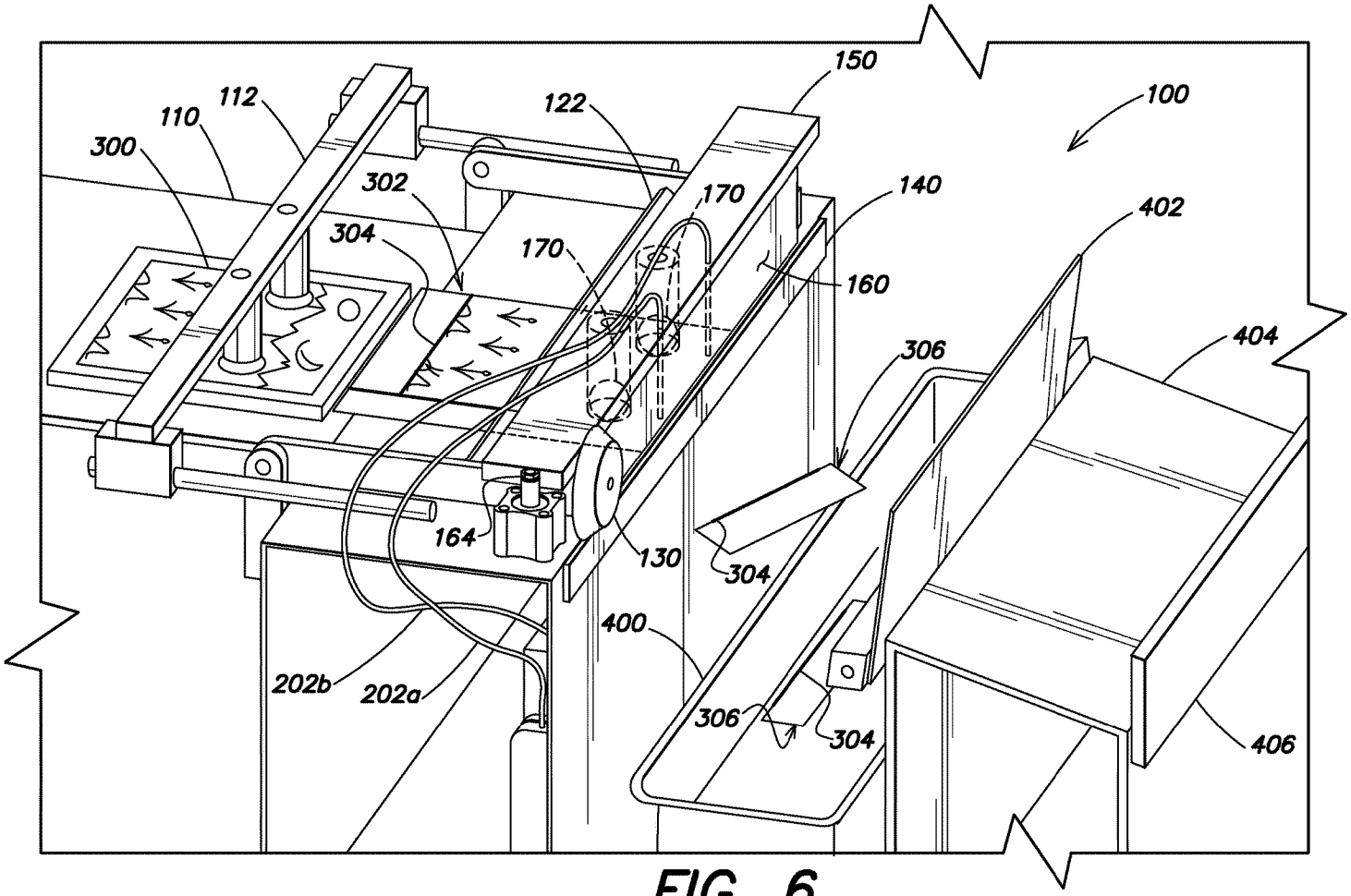
FIG. 6 is a perspective view of the apparatus cutting a second portion of the print sheet.
Figure 7:
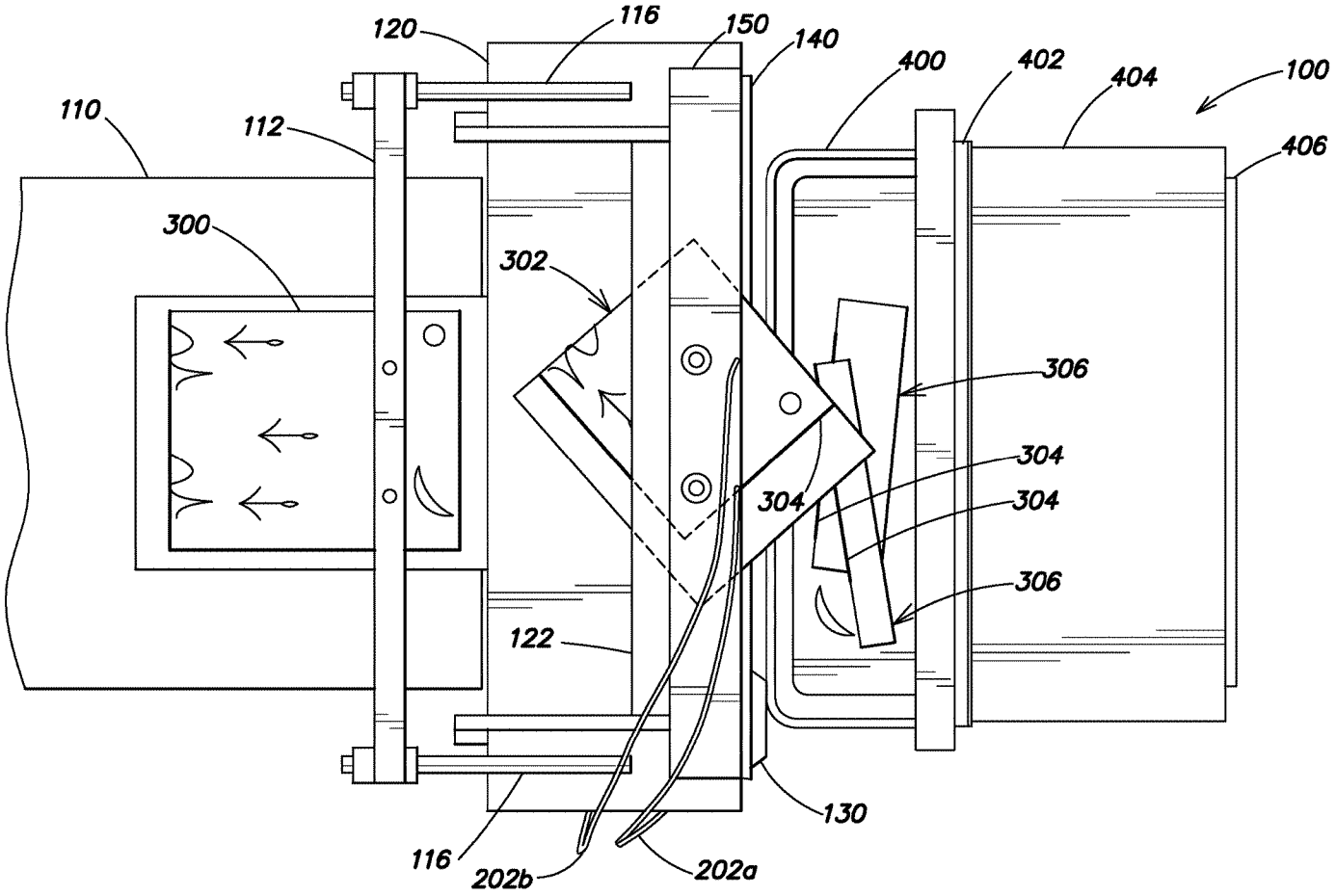
FIG. 7 is a top view of the apparatus rotating a print sheet.

As shown in FIG. 5, once the first portion 306 of the print sheet is effectively trimmed, it may drop into a waste bin 400. Thereafter, the wheels may be activated to drive the remaining sheet to the calculated center and then to rotate the print sheet relative to the cutter. In one embodiment, two wheels may be rotated in opposite directions to rotate the print sheet. After sheet rotation is complete the sheet may be driven away from the cutter until both sensors recognize the sheet is no longer present. Once both sensor see nothing, the direction of the sheet travel is reversed and the sensors may again emit first and second light beams to produce first and second outputs, and a signal including the outputs may be transmitted to the controller to detect the presence of the guide line. The print sheet may be moved by the wheels based upon these outputs to align the guide line relative to the cutter and then as shown in FIG. 6, the cutter may cut a second portion 306 of the print sheet. In one illustrative embodiment, after each complete cut, the print sheet is re-centered and then rotated approximately 90 degrees relative to the cutter. FIG. 7 illustrates the print sheet 302 in the middle of its second 90 degree rotation. As shown, two portions 306 of the print sheet have been removed from the print sheet and have dropped into the waste bin 400, and two more portions of the print sheet still remain on the print sheet 302 to be cut by the cutter 130. In one embodiment, these steps are repeated until all four sides of the print sheet have been cut. In one embodiment, these steps are repeated until the guide line has been removed from the print sheet.

As mentioned above, after a print sheet has been trimmed, it may be glued or otherwise secured to rigid panels and a spine. It is also contemplated that the print sheet may be configured as a dust jacket which is folded around (but not glued to) a hard cover book.

As mentioned above, the present invention also contemplates a method of trimming a print sheet which involves positioning the print sheet. The method includes, providing a print sheet and providing a base and a spaced apart plate. A vacuum is applied through first and second vacuum chambers in the plate, such that floats positioned within the vacuum chambers move within the chamber in a direction away from the base such that the print sheet is moveably receivable between the plate and the base. The print sheet is inserted between the base and the plate, and a positive pressure is then created within the first and second vacuum chambers, such that the floats positioned within the chambers move within the chambers in a direction towards the base to contact the print sheet positioned between the plate the base, which may engage the print sheet to the drive wheels.

The method may include moving at least a portion of the print sheet once the print sheet is positioned between the plate and the base. Thereafter, the above-described air cylinders may be used to clamp the print sheet between the plate and the base and then the print sheet may be cut. After cutting, the plate 160 may be elevated away from the print sheet so that the print sheet can then be moved relative to the base. Once a first portion of the print sheet is cut, the print sheet may be re-centered and rotated approximately 90 degrees relative to the base, registered and thereafter, the steps of clamping the print sheet and then cutting at least a portion of the print sheet may be repeated.

As shown in FIG. 4, in one embodiment, the trimming apparatus may include more than two floats 170 and corresponding wheels 230, 240, 250, 260. In one embodiment, it may be desirable to quickly engage friction between the sheet 302 and a third drive wheel while completely disengaging friction between the sheet and the first and second drive wheels. In other words, each vacuum chamber 162 associated with a float 170 may operate independently of each other so that certain wheels are engaged with the print sheet while others are disengaged from the print sheet.

EXAMPLE

The following illustrates a series of exemplary steps which may be performed with a trimming apparatus according to the present invention:

1. Initial state: lift table down, clamp assembly up, waste diverter up, vacuum over floats.
2. The print sheet pile lift table is raised and the feeder vacuum cups grab the top print sheet.
3. The print sheet is carried forward so the leading edge engages left and right drive wheels.
4. Vacuum cups release sheet, vacuum over floats turned off, positive pressure over floats turned on.
5. Both wheels drive sheet toward sensors.
6. Each sensor recognizes the sheet edge and controller records the edge position.
7. Each wheel continues to drive the sheet, moving the printed black guide line toward the sensors.
8. Each wheel stops, independent of the other, when the associated sensor recognizes the black guide line.
9. Each wheel moves a programmable "offset" distance to compensate for distance between the sensors and the knife.
10. The amount of material to be cut away is calculated and recorded in the controller so the centerline position of remainder can be calculated.
11. The clamp assembly lowers onto the sheet and the circular knife traverses the shear bar trimming the waste material from the sheet (FIG. 5).
12. The print sheet is driven so the calculated center of the remainder material is centered over the drive wheels.
13. The sheet is rotated ¼ turn by driving wheels in opposite directions a programmable amount.
14. The sheet is driven backwards to locate and record the sheet edge position nearest the knife.

15. The sheet is driven forward—each wheel stops when associated sensor recognizes the guide line.

16. Each wheel moves a programmable "offset" distance to compensate for distance between the sensors and the knife.

17. The amount of material to be cut away is calculated and recorded in the controller so the centerline position of remainder can be calculated.

18. The clamp assembly lowers onto the sheet and the circular knife traverses the shear bar trimming the waste material from the sheet (FIG. 6).

19. The print sheet is driven so the calculated center of the remainder material is centered over the drive wheels.

20. The sheet is rotated ¼ turn by driving wheels in opposite directions a programmable amount (FIG. 7).

21. The sheet is driven backwards to locate and record the sheet edge position nearest the knife.

22. The sheet is driven forward—each wheel stops when associated sensor recognizes the guide line.

23. Each wheel moves a programmable "offset" distance to compensate for distance between the sensors and the knife.

24. The amount of material to be cut away is calculated and recorded in the controller so the centerline position of remainder can be calculated.

25. The clamp assembly lowers onto the sheet and the circular knife traverses the shear bar trimming the waste material from the sheet.

26. The print sheet is driven so the calculated center of the remainder material is centered over the drive wheels.

27. The sheet is rotated ¼ turn by driving wheels in opposite directions a programmable amount.

28. The sheet is driven backwards to locate and record the sheet edge position nearest the knife.

29. The sheet is driven forward—each wheel stops when associated sensor recognizes the guide line.

30. Each wheel moves a programmable "offset" distance to compensate for distance between the sensors and the knife.

31. The clamp assembly lowers onto the sheet and the circular knife traverses the shear bar trimming the waste material from the sheet.

Figure 8:
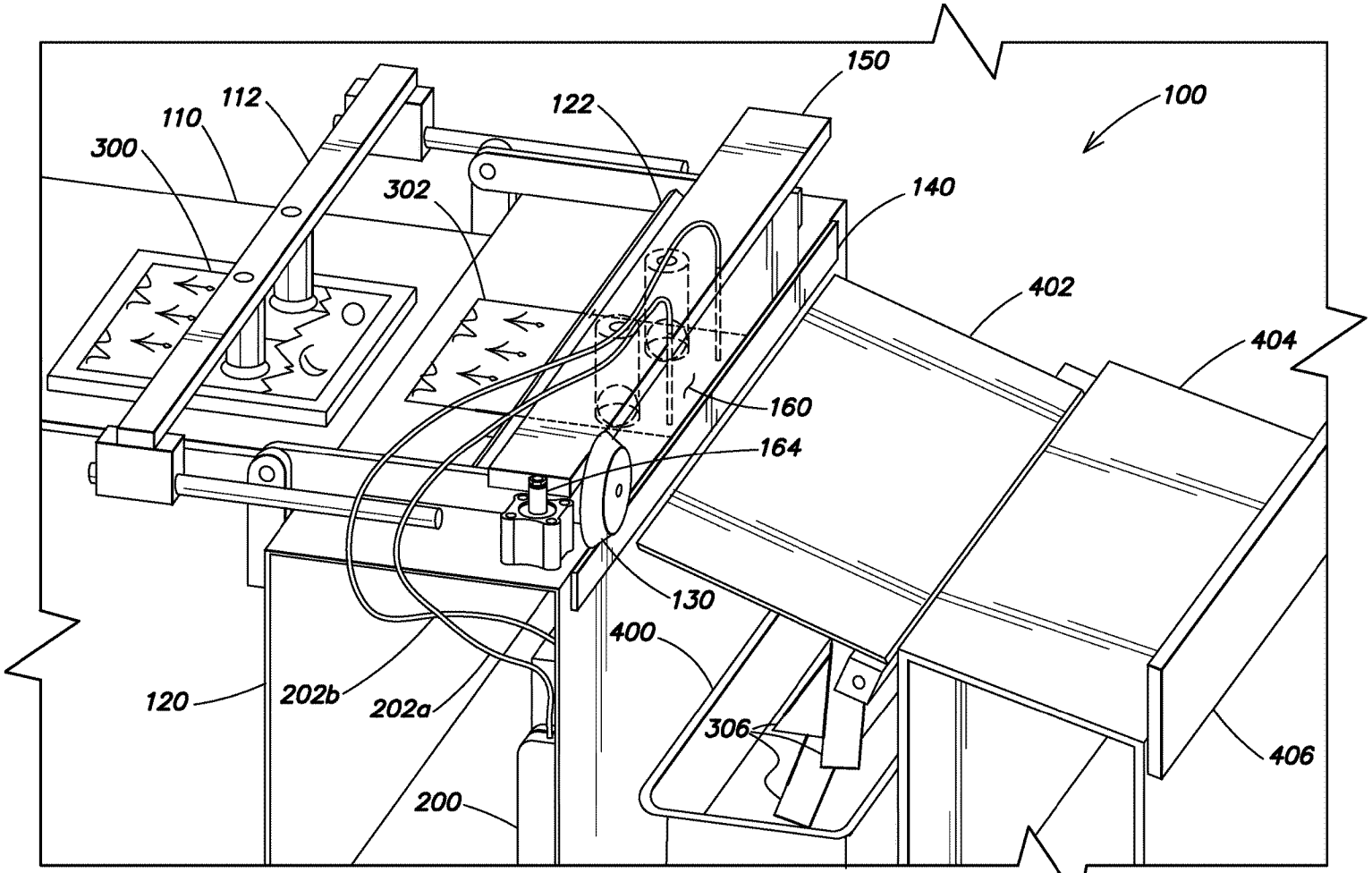
FIG. 8 is a perspective view of the apparatus illustrating a waste diverter in a closed position.

32. The diverter gate is lowered (FIG. 8).

33. Both wheels drive the trimmed sheet out of the machine, across the diverter gate, and onto the outfeed table.

34. Lift diverter gate.

The foregoing detailed description has been presented for the purposes of illustration and description. It is not intended to be exhaustive or to limit the invention to the particular disclosed embodiments. Numerous variations and configurations will be apparent in light of this disclosure. Thus its intended that the scope of the invention be defined not be this detailed description, but rather by the claims appended hereto.

What is claimed is:

1. An apparatus for trimming a print sheet, the apparatus comprising:

a base configured to receive a print sheet;

a cutter coupled to the base, the cutter constructed and arranged to cut at least a portion of the print sheet;

a sensor system constructed and arranged to detect a guide line on the print sheet to align the print sheet relative to the cutter, wherein the sensor system comprises:

a first sensor configured to emit a first light beam through the print sheet; and a second sensor configured to emit a second light beam through the print sheet, wherein the first light beam is spaced apart from the second light beam; and a controller in communication with the sensor system and the cutter, wherein the controller is configured to detect the presence of the guide line through the first and second light beams to align the guide line on the print sheet relative to the cutter.

2. The apparatus of claim 1, wherein the controller is configured to detect an edge of the print sheet to calculate the distance between the guide line and the edge.

3. The apparatus of claim 1, wherein the controller is configured to determine the position of a printed image on the print sheet, where a guide line defines a perimeter of the printed image.

4. The apparatus of claim 1, wherein the cutter is a circular knife constructed and arranged to rotate across a portion of the base.

5. The apparatus of claim 1, further comprising:

at least one wheel coupled to the base, the at least one wheel constructed and arranged to move the print sheet relative to the cutter; and wherein the controller is in communication with the least one wheel, and wherein the controller is configured to initiate movement of the at least one wheel.

6. The apparatus of claim 5, wherein the controller is configured to move the print sheet when the first and second light beams are not aligned with the guide line.

7. The apparatus of claim 5, wherein once the first and second light beams are aligned with the guide line, the controller is configured to move the print sheet a programmed offset distance to align the cutter with the guide line such that the cutter is configured to remove the guide line from the print sheet.

8. The apparatus of claim 5, wherein the at least one wheel includes at least a first wheel and a second wheel spaced apart from the first wheel, wherein the first wheel and the second wheel are constructed and arranged to move the print sheet relative to the cutter.

9. The apparatus of claim 8, wherein the base includes a first opening and a second opening, wherein the first wheel and the second wheel are each coupled to the base such that at least a portion of the first wheel extends into the first opening in the base and at least a portion of the second wheel extends into the second opening in the base.

10. The apparatus of claim 1, wherein the first sensor further comprises:

a first fiber optic cable having a first end;

a second fiber optic cable, wherein the second fiber optic cable is spaced apart from the first end of the first fiber optic cable to form a space there between configured to receive the print sheet; and wherein the first and second fiber optic cables are configured such that first light beam travels through the first end of the first fiber optic cable to the second fiber optic.

11. The apparatus of claim 10, wherein the second sensor further comprises:

a third fiber optic cable having a first end;

a fourth fiber optic cable, wherein the fourth fiber optic cable is spaced apart from the first end of the third fiber optic cable to form a space there between configured to receive the print sheet; and wherein the third and fourth fiber optic cables are configured such that second light beam travels through the first end of the third fiber optic cable to the fourth fiber optic.

12. The apparatus of claim 1, in combination with the print sheet.

13. The apparatus of claim 12, wherein the print sheet has a printed image surrounded by a guide line which defines an outer perimeter edge to be cut by the cutter.

14. The apparatus of claim 1, wherein the first and second light beams are visible red light beams.

15. The apparatus of claim 1, further comprising:

a waste bin adjacent the cutter, the waste bin constructed and arranged to receive a portion of the print sheet that has been removed by the cutter; and an output table configured to receive a finished print sheet, the output table having a waste diverter moveable between an open position and a closed position, wherein in the open position, cut portions of the print sheet can fall into the waste bin, and in the closed position, the waste diverter couples the base to the output table so that a finished print sheet is moveable from the base to the output table.

16. The apparatus of claim 1, further comprising:

a lift table positioned adjacent the base, the lift table configured to receive a stack of print sheets; and a plurality of vacuum cups positioned above the lift table, the plurality of vacuum cups configured to separate one print sheet from a stack of print sheets on the lift table and move the one print sheet over to the base.

17. An apparatus for registering the location of an image on a print sheet, the apparatus comprising:

a base configured to receive a print sheet;

at least one wheel coupled to the base, the at least one wheel constructed and arranged to move the print sheet relative to the base;

a sensor system constructed and arranged to detect a guide line on the print sheet which defines an outer perimeter of an image on the print sheet, wherein the sensor system comprises:

a first sensor configured to emit a first light beam through the print sheet; and a second sensor configured to emit a second light beam through the print sheet, wherein the first light beam is spaced apart from the second light beam; and a controller in communication with the sensor system and the wheel, wherein the controller is configured to move the print sheet relative to the base, and to detect the presence of the guide line through the first and second light beams to register the location of the outer perimeter of an image on the print sheet.

18. The apparatus of claim 17, wherein the controller is configured to detect an edge of the print sheet to calculate the distance between the guide line and the edge.

19. The apparatus of claim 17, further comprising:

a tool coupled to the base, wherein the tool is configured to modify at least a portion of the print sheet, and wherein the controller is in communication with the tool and is configured to align the guide line on the print sheet relative to a cutter.

20. The apparatus of claim 19, wherein the tool is constructed and arranged to cut at least a portion of the print sheet.

* * * * *